US007228935B2

(12) United States Patent
Schlessmann

(10) Patent No.: US 7,228,935 B2
(45) Date of Patent: Jun. 12, 2007

(54) ATTACHMENT PIN FOR AN EXHAUST-GAS MUFFLER

(75) Inventor: Helmut Schlessmann, Prüm (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 494 days.

(21) Appl. No.: 10/658,267

(22) Filed: Sep. 10, 2003

(65) Prior Publication Data

US 2005/0191148 A1 Sep. 1, 2005

(30) Foreign Application Priority Data

Sep. 10, 2002 (DE) ..... 104 41 883

(51) Int. Cl.
*F01N 5/00* (2006.01)

(52) U.S. Cl. ..... 181/212; 181/228; 181/231; 411/389; 411/546; 403/408.1; 173/DIG. 2

(58) Field of Classification Search ..... 411/389, 411/546; 181/229, 230, 231, 243, 228, 240, 181/212; 180/296, 309, 89.2; 403/408.1; 173/DIG. 2

See application file for complete search history.

(56) References Cited

U.S. PATENT DOCUMENTS 197,721 A * 12/1877 Cornell ..... 403/8
313,193 A * 3/1885 Gaylord ..... 403/8
375,907 A * 1/1888 Whitmore ..... 411/389
571,042 A * 11/1896 Edquist ..... 403/8
928,237 A * 7/1909 Baird ..... 285/239
1,126,531 A * 1/1915 Liebmann ..... 411/405
1,257,134 A * 2/1918 Shivers ..... 181/229
1,335,613 A * 3/1920 Cuno ..... 411/368
1,391,633 A * 9/1921 Hazelton ..... 74/424.78
1,394,072 A * 10/1921 Egbert ..... 220/89.2
1,547,601 A * 7/1925 Maxim ..... 181/230
1,574,466 A * 2/1926 Brown ..... 464/33
1,610,934 A * 12/1926 Delany ..... 411/394
1,644,477 A * 10/1927 Klaus ..... 411/389
1,864,080 A * 6/1932 Madge ..... 267/141.4
1,890,151 A * 12/1932 Hadley ..... 285/324
1,896,388 A * 2/1933 Zeidler ..... 411/176
1,898,126 A * 2/1933 Mead ..... 123/198 D
2,136,098 A * 11/1938 Browne ..... 137/565.18
2,244,393 A * 6/1941 Haas ..... 181/243
2,260,237 A * 10/1941 Stahl ..... 96/382
2,263,050 A * 11/1941 Rein ..... 5/296
2,277,356 A * 3/1942 Sargent ..... 137/328
2,419,664 A * 4/1947 Tabbert ..... 96/381
2,425,935 A * 8/1947 Hayman ..... 174/135

(Continued)

OTHER PUBLICATIONS

"Spacers and Standoffs" McMaster-Carr online catalog pp. 3085-3087.*

*Primary Examiner*—Robert J. Sandy
*Assistant Examiner*—Jeff Sharp
(74) *Attorney, Agent, or Firm*—Walter Ottesen

(57) ABSTRACT

The invention relates to an attachment pin (1) for fixing an exhaust-gas muffler (2) in an apparatus part (4) of a portable handheld work apparatus (5) driven by an internal combustion engine. The exhaust-gas muffler (2) includes especially an exhaust-gas catalytic converter (3). An at least partially exposed region (6) is provided with a cooling surface (7) and is on the attachment pin (1) between the exhaust-gas muffler (2) and the apparatus part (4).

4 Claims, 4 Drawing Sheets

U.S. PATENT DOCUMENTS

| | | | | | |
|---|---|---|---|---|---|
| 2,629,544 | A | * | 2/1953 | Ohmart | 181/229 |
| 2,815,088 | A | * | 12/1957 | Gibel | 181/230 |
| 2,877,732 | A | * | 3/1959 | Eaton | 114/22 |
| 2,934,684 | A | * | 4/1960 | Fegan | 257/658 |
| 3,137,365 | A | * | 6/1964 | Bingel | 181/230 |
| 3,163,255 | A | * | 12/1964 | Stryker | 181/230 |
| 3,208,551 | A | * | 9/1965 | Carls | 181/226 |
| 3,245,142 | A | * | 4/1966 | Williams | 29/446 |
| 3,276,172 | A | * | 10/1966 | Bror | 52/127.12 |
| 3,323,615 | A | * | 6/1967 | Kessler | 181/230 |
| 3,330,378 | A | * | 7/1967 | Waldron | 181/230 |
| 3,365,022 | A | * | 1/1968 | Barber et al. | 181/230 |
| 3,380,553 | A | * | 4/1968 | Gibel | 181/230 |
| 3,384,200 | A | * | 5/1968 | Baker et al. | 181/230 |
| 3,482,649 | A | * | 12/1969 | Murphy | 181/240 |
| 3,521,413 | A | * | 7/1970 | Scott et al. | 52/98 |
| 3,547,223 | A | * | 12/1970 | Gibel | 181/230 |
| 3,557,902 | A | * | 1/1971 | Brown et al. | 181/229 |
| 3,561,561 | A | * | 2/1971 | Trainor | 181/267 |
| 3,622,194 | A | * | 11/1971 | Bryk | 296/35.1 |
| 3,637,244 | A | * | 1/1972 | Strizki | 52/98 |
| 3,680,659 | A | * | 8/1972 | Kasten | 181/230 |
| 3,703,937 | A | * | 11/1972 | Tenney | 181/226 |
| 3,765,607 | A | * | 10/1973 | Pacht | 239/124 |
| 3,783,590 | A | * | 1/1974 | Allen | 96/419 |
| 3,802,538 | A | * | 4/1974 | Brown | 181/230 |
| 3,880,252 | A | * | 4/1975 | Mucka | 181/230 |
| 3,897,112 | A | * | 7/1975 | Walther et al. | 301/13.2 |
| 3,897,713 | A | * | 8/1975 | Gugle | 411/389 |
| 3,898,063 | A | * | 8/1975 | Gazan | 96/384 |
| 3,949,828 | A | * | 4/1976 | Frochaux | 181/230 |
| 3,951,556 | A | * | 4/1976 | Strizki | 403/2 |
| 3,967,906 | A | * | 7/1976 | Strizki | 403/2 |
| 4,015,504 | A | * | 4/1977 | Rosan et al. | 411/389 |
| 4,033,428 | A | * | 7/1977 | Wennerstrom | 181/230 |
| 4,068,987 | A | * | 1/1978 | Crooks | 418/181 |
| 4,093,110 | A | * | 6/1978 | Johnson | 227/9 |
| 4,109,749 | A | * | 8/1978 | Sweet | 181/230 |
| 4,111,278 | A | * | 9/1978 | Bergman | 181/249 |
| 4,113,052 | A | * | 9/1978 | McElroy, Jr. | 181/230 |
| 4,134,472 | A | * | 1/1979 | Trainor | 181/258 |
| 4,135,602 | A | * | 1/1979 | Clark | 181/230 |
| 4,219,100 | A | * | 8/1980 | Wyse | 181/230 |
| 4,239,013 | A | * | 12/1980 | Haynes | 440/40 |
| 4,258,798 | A | * | 3/1981 | Campbell et al. | 173/168 |
| 4,299,305 | A | * | 11/1981 | Eriksson | 181/230 |
| 4,304,503 | A | * | 12/1981 | Gehring et al. | 411/389 |
| 4,316,523 | A | * | 2/1982 | Boretti | 181/226 |
| 4,320,864 | A | * | 3/1982 | Novak et al. | 227/130 |
| 4,334,815 | A | * | 6/1982 | Knohl | 411/368 |
| 4,371,319 | A | * | 2/1983 | Murayama et al. | 417/312 |
| 4,401,418 | A | * | 8/1983 | Fritchman | 417/312 |
| 4,449,609 | A | * | 5/1984 | Stoll | 181/230 |
| 4,510,898 | A | * | 4/1985 | Ampferer | 123/192.1 |
| 4,624,415 | A | * | 11/1986 | Hofstetter, Jr. | 239/590.3 |
| 4,638,608 | A | * | 1/1987 | Coy | 52/98 |
| 4,653,957 | A | * | 3/1987 | Smith et al. | 404/114 |
| 4,673,240 | A | * | 6/1987 | Byfield, Jr. | 439/755 |
| 4,677,940 | A | * | 7/1987 | Bracht et al. | 123/2 |
| 4,690,365 | A | * | 9/1987 | Miller et al. | 248/650 |
| 4,729,707 | A | * | 3/1988 | Takahashi | 411/389 |
| 4,749,058 | A | * | 6/1988 | Trainor | 181/239 |
| 4,768,616 | A | * | 9/1988 | Richard et al. | 181/233 |
| 4,784,583 | A | * | 11/1988 | Bar | 417/312 |
| 4,786,201 | A | * | 11/1988 | Huetter et al. | 403/22 |
| 4,854,417 | A | * | 8/1989 | Uesugi et al. | 181/272 |
| 4,858,722 | A | * | 8/1989 | Abbe et al. | 181/243 |
| RE33,050 | E | * | 9/1989 | Tuggle et al. | 15/330 |
| 4,874,062 | A | * | 10/1989 | Yanagida et al. | 181/250 |
| 4,923,319 | A | * | 5/1990 | Dent | 403/2 |
| 4,988,067 | A | * | 1/1991 | Propp et al. | 248/343 |
| 4,988,584 | A | * | 1/1991 | Shaper | 429/50 |
| 5,040,917 | A | * | 8/1991 | Camuffo | 403/408.1 |
| 5,055,010 | A | * | 10/1991 | Logan | 417/410.5 |
| 5,097,924 | A | * | 3/1992 | Reeves | 181/230 |
| 5,104,271 | A | * | 4/1992 | Lechler | 411/166 |
| 5,125,194 | A | * | 6/1992 | Granger | 52/98 |
| 5,160,284 | A | * | 11/1992 | Krom | 439/797 |
| 5,173,034 | A | * | 12/1992 | Riffe | 417/312 |
| 5,205,719 | A | * | 4/1993 | Childs et al. | 417/312 |
| 5,220,811 | A | * | 6/1993 | Harper et al. | 62/296 |
| 5,243,764 | A | * | 9/1993 | Wieland | 30/383 |
| 5,309,714 | A | * | 5/1994 | Putney et al. | 60/407 |
| 5,312,005 | A | * | 5/1994 | Odell | 211/189 |
| 5,317,112 | A | * | 5/1994 | Lee | 181/250 |
| 5,333,978 | A | * | 8/1994 | Rives | 411/389 |
| 5,340,258 | A | * | 8/1994 | Simon | 411/535 |
| 5,358,367 | A | * | 10/1994 | Yang | 411/397 |
| 5,418,339 | A | * | 5/1995 | Bowen et al. | 181/230 |
| 5,474,408 | A | * | 12/1995 | Dinitz et al. | 411/5 |
| 5,489,753 | A | * | 2/1996 | Gibel | 181/230 |
| 5,533,580 | A | * | 7/1996 | Reaves | 173/114 |
| 5,573,371 | A | * | 11/1996 | Kieffer | 415/182.1 |
| 5,577,898 | A | * | 11/1996 | Lee | 417/312 |
| 5,581,055 | A | * | 12/1996 | Self et al. | 181/230 |
| 5,596,845 | A | * | 1/1997 | Strizki | 52/98 |
| 5,611,409 | A | * | 3/1997 | Arseneau | 181/228 |
| 5,613,968 | A | * | 3/1997 | Lin | 606/61 |
| 5,697,766 | A | * | 12/1997 | Oh | 417/312 |
| 5,709,513 | A | * | 1/1998 | Tsai | 411/107 |
| 5,769,583 | A | * | 6/1998 | Girbinger | 411/389 |
| 5,772,252 | A | * | 6/1998 | Malani | 285/4 |
| 5,844,177 | A | * | 12/1998 | Pirchl | 181/211 |
| 5,855,443 | A | * | 1/1999 | Faller et al. | 403/2 |
| 5,906,477 | A | * | 5/1999 | Kim et al. | 417/312 |
| 5,992,170 | A | * | 11/1999 | Yap | 62/296 |
| 5,996,731 | A | * | 12/1999 | Czabala et al. | 181/229 |
| 6,041,890 | A | * | 3/2000 | Wolf et al. | 181/230 |
| 6,044,926 | A | * | 4/2000 | Yamane et al. | 181/230 |
| 6,056,471 | A | * | 5/2000 | Dinitz | 403/2 |
| 6,062,791 | A | * | 5/2000 | Simon | 411/535 |
| 6,072,880 | A | * | 6/2000 | Shipps et al. | 381/71.5 |
| 6,076,794 | A | * | 6/2000 | Pradel | 267/220 |
| 6,089,348 | A | * | 7/2000 | Bokor | 181/272 |
| 6,095,460 | A | * | 8/2000 | Mercer et al. | 248/59 |
| 6,095,481 | A | * | 8/2000 | Norkus et al. | 248/560 |
| 6,146,050 | A | * | 11/2000 | Marshall | 403/400 |
| 6,151,982 | A | * | 11/2000 | Matsumoto et al. | 74/493 |
| 6,158,215 | A | * | 12/2000 | Bosch et al. | 60/312 |
| 6,164,062 | A | * | 12/2000 | Blichmann | 60/272 |
| 6,164,066 | A | * | 12/2000 | Sakaguchi et al. | 60/302 |
| 6,164,410 | A | * | 12/2000 | Linsbauer et al. | 181/230 |
| 6,202,785 | B1 | * | 3/2001 | Hilling et al. | 181/230 |
| 6,209,678 | B1 | * | 4/2001 | Sterling | 181/230 |
| 6,308,927 | B1 | * | 10/2001 | Leahy | 248/548 |
| 6,325,472 | B1 | * | 12/2001 | Tirrell et al. | 312/223.1 |
| 6,328,513 | B1 | * | 12/2001 | Niwa et al. | 411/339 |
| 6,367,580 | B1 | * | 4/2002 | Chang | 181/241 |
| 6,374,943 | B1 | * | 4/2002 | Choi | 181/229 |
| 6,382,931 | B1 | * | 5/2002 | Czabala et al. | 417/312 |
| 6,406,239 | B1 | * | 6/2002 | Mauri | 411/383 |
| 6,505,697 | B2 | * | 1/2003 | Monneau | 180/89.2 |
| 6,572,127 | B2 | * | 6/2003 | Pazdirek | 280/124.152 |
| 6,575,536 | B2 | * | 6/2003 | Chen | 301/35.623 |
| 6,641,326 | B2 | * | 11/2003 | Schilling et al. | 403/337 |
| 6,669,422 | B1 | * | 12/2003 | Sterle | 411/384 |
| 6,688,856 | B1 | * | 2/2004 | Motegi et al. | 417/312 |
| 6,758,512 | B2 | * | 7/2004 | Dobbs | 296/146.5 |
| 6,826,878 | B1 | * | 12/2004 | Rovtar | 52/213 |
| 6,827,538 | B2 | * | 12/2004 | Doppke et al. | 411/389 |
| 6,860,686 | B2 | * | 3/2005 | Schneider | 411/34 |
| 6,863,154 | B2 | * | 3/2005 | Uegane et al. | 181/207 |
| 6,880,787 | B2 | * | 4/2005 | Stephen et al. | 248/68.1 |
| 6,926,117 | B2 | * | 8/2005 | Sterling | 181/230 |

6,935,460 B2 * 8/2005 McCombs et al. ..... 181/258
6,935,848 B2 * 8/2005 Marshal et al. ..... 417/312
6,953,313 B2 * 10/2005 Tylosky ..... 411/389
6,959,902 B2 * 11/2005 Leahy ..... 248/548
6,997,662 B2 * 2/2006 Nishikawa ..... 411/437
7,007,720 B1 * 3/2006 Chase et al. ..... 138/110
7,073,346 B2 * 7/2006 Ramachandran et al. ..... 62/292
7,083,400 B2 * 8/2006 Possamai et al. ..... 417/559
2002/0027041 A1 * 3/2002 Czabala et al. ..... 181/229
2003/0030201 A1 * 2/2003 Williams ..... 267/140.13
2003/0136607 A1 * 7/2003 Kawamata et al. ..... 181/231
2003/0155169 A1 * 8/2003 Kromis et al. ..... 180/309
2004/0055815 A1 * 3/2004 Sterling ..... 181/230
2004/0060763 A1 * 4/2004 Stodolka ..... 180/309
2004/0069562 A1 * 4/2004 Kondo et al. ..... 181/227
2004/0081537 A1 * 4/2004 Nishikawa ..... 411/437
2004/0200665 A1 * 10/2004 Adams ..... 181/240
2004/0238273 A1 * 12/2004 Fritskey et al. ..... 181/264
2005/0079032 A1 * 4/2005 Pazdirek et al. ..... 411/389
2005/0082113 A1 * 4/2005 Okunosono ..... 181/227
2005/0150716 A1 * 7/2005 Nasuno et al. ..... 181/231
2005/0155818 A1 * 7/2005 Wirtz ..... 181/269
2005/0189166 A1 * 9/2005 Kikuchi et al. ..... 181/237
2005/0191149 A1 * 9/2005 Boudreaux et al. ..... 411/149
2005/0198802 A1 * 9/2005 McPherson ..... 29/430
2005/0217908 A1 * 10/2005 Rini et al. ..... 180/68.1
2005/0224284 A1 * 10/2005 Ohno et al. ..... 181/272
2005/0247516 A1 * 11/2005 Uegane ..... 181/228
2005/0263344 A1 * 12/2005 Warfel et al. ..... 181/231

* cited by examiner

ATTACHMENT PIN FOR AN EXHAUST-GAS MUFFLER

BACKGROUND OF THE INVENTION

In portable handheld work apparatus driven by an internal combustion engine, the hot exhaust gases of the engine are guided through an exhaust-gas muffler. Such work apparatus include chain saws, brushcutters, suction/blower apparatus or the like. The exhaust-gas muffler assumes considerable temperatures. An exhaust-gas catalytic converter, which is possibly integrated into the exhaust-gas system, brings about an after burning of incompletely combusted exhaust-gas components. A considerable increase of the temperature level in the exhaust-gas system can, under circumstances, take place because of the after burning in the exhaust-gas catalytic converter.

An exhaust-gas muffler, which is equipped with an exhaust-gas catalytic converter as needed, is affixed to any desired apparatus part of the portable handheld work apparatus with one or several attachment pins. The attachment pins can be configured as threaded fasteners, stud bolts or the like and are especially subjected to mechanical vibration loads as well as thermal loads. The attachment pins define a thermal bridge between the exhaust-gas muffler which is hot during operation and the comparatively cooler apparatus part. Temperature fluctuations in the exhaust-gas muffler, for example, because of frequently changing power outputs or starting and stopping of the engine can lead to a loosening of the attachment pins especially in combination with vibration loads resulting from the engine operation. When the apparatus part, which receives the attachment pins, is configured of a light metal, especially magnesium or a corresponding plastic material, a high heat entry via the attachment pin can lead to a creeping of the material of the apparatus in the region of the attachment pin. The creeping of the material receiving the attachment pin can, likewise, lead to an unwanted automatic loosening of the exhaust-gas muffler attachment.

For a reliable attachment of an exhaust-gas muffler, configurations of attachment pins are known wherein a comparatively long threaded section is provided at the apparatus end. A relatively large transition surface can be provided for the introduced heat via the long threaded section threadably engaged in the housing part. During operation, a comparatively low temperature level is present on the end of the threaded section facing away from the exhaust-gas muffler. At least in this region, a permanently secure threaded connection can be obtained especially in association with an adhesive.

A sufficient amount of structural space is not always available for accommodating the correspondingly long threaded section. A correspondingly long configuration of the attachment pin can, under certain circumstances, not lead to the desired success especially for a high temperature level caused by an exhaust-gas catalytic converter. An adhesive locking of the threaded fastener leads to a cost intensive assembly operation. Creeping of the material, which accommodates the threaded section, cannot be avoided under some circumstances, at least not in the hotter region of the threaded section.

SUMMARY OF THE INVENTION

It is an object of the invention to provide an attachment pin for an exhaust-gas muffler which is improved in such a manner that a temperature stable fixation of the exhaust-gas muffler is possible with simple means.

The attachment pin arrangement of the invention is for attaching an exhaust-gas muffler to an apparatus part of a portable handheld work apparatus driven by an internal combustion engine. The attachment pin arrangement includes: an attachment pin extending between the housing part and the muffler; and, the attachment pin including at least a partially exposed region between the housing part and the muffler and the region defining a cooling surface.

According to a feature of the invention, an at least partially exposed region having a cooling surface is provided on the attachment pin between the exhaust-gas muffler and the apparatus part. At least part of the heat, which is introduced from the exhaust-gas muffler into the attachment pin, can be conducted away by means of radiation and/or convection via the cooling surface in the exposed region. The remaining heat flow is correspondingly reduced and is introduced into the apparatus part via the attachment pin by means of heat conduction. This remaining heat flow leads to a correspondingly reduced temperature level in the region of the receptacle of the attachment pin. The section of the attachment pin, which is accommodated by the apparatus part, can be configured to be correspondingly short which leads to an overall reduced volume of structure. A creeping of the material, which accommodates the attachment pin, can be reliably avoided. An additional adhesive locking of a threaded section, which is held in the apparatus part, can be omitted depending upon circumstances.

According to another feature of the invention, at least one collar is provided to form a cooling surface. This collar extends peripherally about the attachment pin. The peripheral collar avoids a weakening of the cross section of the attachment pin and leads with simple means to a large area cooling surface which therefore is effective. The peripherally-extending collar can also be configured as a stop for an attachment pin to be threadably engaged in the apparatus part. A defined assembly position results during assembly without having to do more. A surface contact engagement of the peripherally-extending collar on the apparatus part leads to an areal introduction of remaining heat energy into the apparatus part. Unwanted temperature peaks are avoided with the areal contact. Alternatively, or even in combination with a peripherally-extending collar, a slot is provided extending about the attachment pin. A comparatively effective cooling surface can be obtained with simple means via the slot. A lesser cross section in the attachment pin results in this region in dependence upon the selected depth of the slot. The reduced cross section leads effectively to a reduced heat transfer through the attachment pin from the exhaust-gas muffler in the direction of the apparatus part accommodating the attachment pin. Here, it is practical to arrange a slot between a first collar and a second collar. The effect of large area cooling surfaces can thereby be combined with simple means with the action of the slot which limits the heat transfer.

The cooling surfaces can be made available by a component, which is structured correspondingly on the surface, for example, in the form of a sleeve which can be pushed onto the attachment pin. According to another feature of the invention, the peripherally-extending collar is formed as one piece with the attachment pin. In addition to reduced manufacturing costs, a good heat transfer results from the core of the attachment pin into the peripherally-extending collar. The correspondingly high temperature level in the collar leads to a correspondingly high proportionate heat output.

In an advantageous further embodiment, the attachment pin has at least one threaded section and the peripherally-extending collar is configured as a hexagon. In addition to the function as a cooling surface, the hexagonally-shaped collar can function as a projection which can be grasped by a work tool for imparting rotation. Via the hexagon, the attachment pin can be rotated in a simple manner into a corresponding threaded receptacle of an apparatus part. The attachment pin can be counter held with a suitable tool for tightening or loosening a holding nut for the exhaust-gas muffler.

To further reduce the temperature level in the region of the apparatus part receiving the attachment pin, it can be practical to provide a heat insulating spacer means between a holding flange of the exhaust-gas muffler and a collar facing toward the holding flange. With the overall reduced introduction of heat from the exhaust-gas muffler into the attachment pin, the temperature level in this region is overall reduced. To obtain the same effect, it can also be practical to mount a heat insulating spacer means between the holding flange and a holding nut threadably engaged on the attached pin. One or even both spacer means can be correspondingly configured to have a large area. The holding flange is reliably held while avoiding excessive introduction of heat. For this purpose, the spacer means is configured as supporting washer, especially made of titanium or a heat-resistant duroplast. The suggested material selection leads to a high mechanical supporting capacity in combination with a low heat introduction into the attachment pin. The attachment pin itself can be made of steel. Steel has a high mechanical supporting capacity even at increased temperature levels. The thermal conductivity, which is disadvantageous in the present case, is adequately low with a corresponding selection of steel. With the selection of a heat resistant steel, a comparatively low material cross section can be selected whereby the unwanted heat transfer from the exhaust-gas muffler in the direction of the apparatus part, which receives the attachment pin, can be further reduced.

In a practical further embodiment, one or both spacer means have a centering collar for the holding flange of the exhaust-gas muffler. In addition to a mechanical attachment, which can be subjected to load, a precisely defined assembly position of the exhaust-gas muffler is achieved. Even with thermal or mechanical settlement, the holding flange cannot come in direct contact with the attachment pin. In this way, a good thermal insulation between the exhaust-gas muffler or its holding flange and the attachment pin is permanently ensured.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
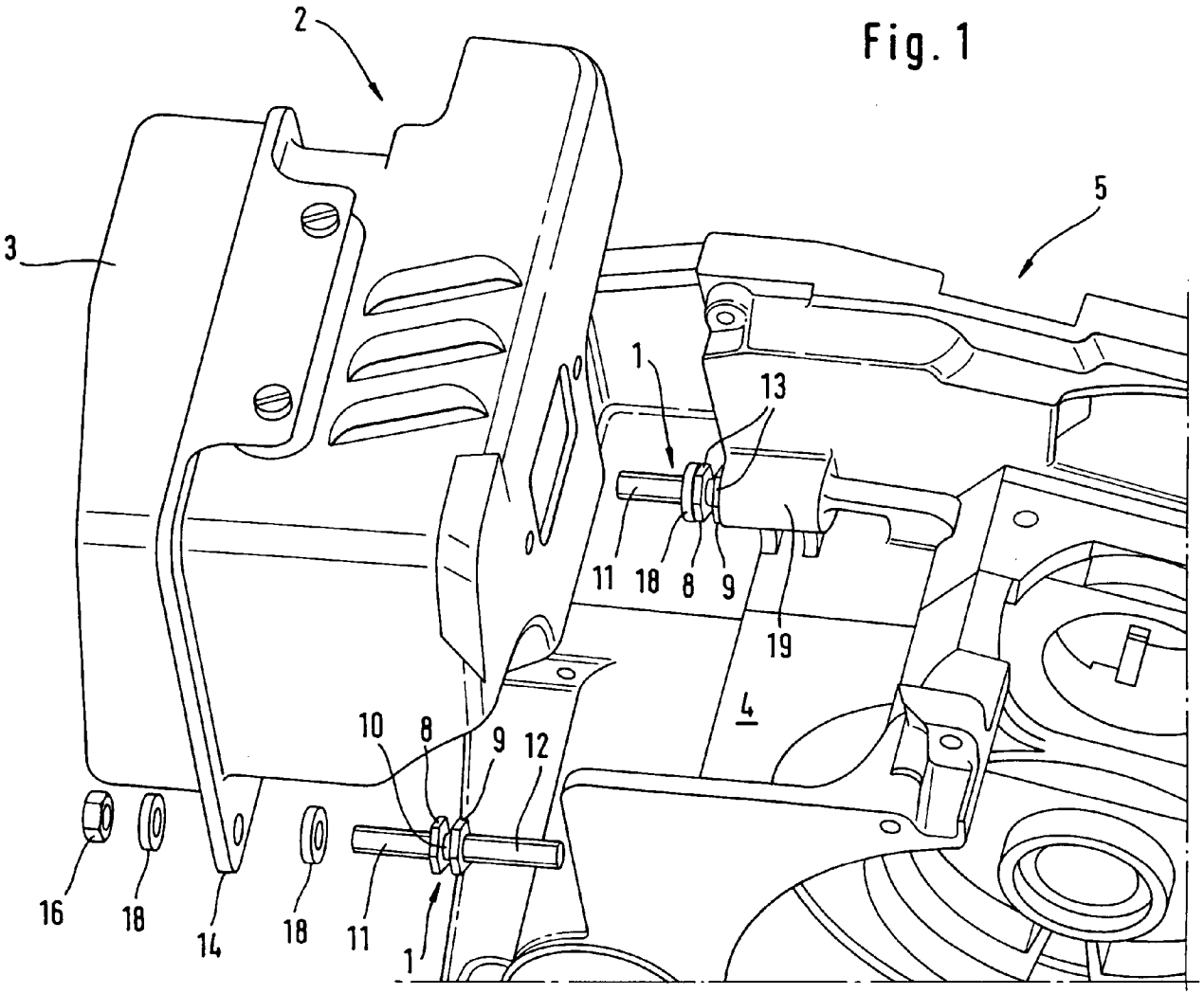
FIG. 1 is a perspective view of a portion of a work apparatus having an exhaust-gas muffler including an exhaust-gas catalytic converter and two attachment pins having respective cooling surfaces.

FIG. 1 shows a perspective cutaway view of a portable handheld work apparatus 5 driven by an internal combustion engine (not shown). Here, the work apparatus is a motor-driven chain saw by way of example. The work apparatus 5 can also be a brushcutter, a suction/blower apparatus or the like. An exhaust-gas muffler 2 is provided for directing away the exhaust gases of the engine and to attenuate noise. The exhaust-gas muffler includes an exhaust-gas catalytic converter 3 in the embodiment shown.

The work apparatus 5 includes an apparatus part 4 which, in the embodiment shown, is a combined crankcase and cooling fan housing for the engine made of a magnesium die casting. The apparatus part 4 can be any part of the work apparatus 5 and can be made, for example, of aluminum, plastic or the like.

The exhaust-gas muffler can be attached to the apparatus part 4 by means of attachment pins 1. The attachment pins 1 are all configured the same and have a threaded section 12 at the apparatus end and a threaded section 11 at the exhaust-gas muffler end. One of the two attachment pins 1 shown is shown threadably engaged with its threaded section 12 in a threaded protuberance 19. The threaded protuberance 19 is configured as one piece with the apparatus part 4. The attachment pins 1 each have first and second peripherally-extending collars (8, 9) approximately midway along the length thereof and a slot 10 is arranged between the two collars. The two peripherally-extending collars (8, 9) are configured as one piece with the attachment pins 1 and are configured as hexagonals 13. In the mounted state, the apparatus-end collar 9 lies in areal contact against the threaded protuberance 19.

The exhaust-gas muffler 2 includes a holding flange 14 for fixing on the attachment pin 1. The holding flange 14 can be pushed onto the muffler-end threaded section 11 of the attachment pin 1. Two support washers 18 can be pushed onto the threaded section 11. The holding flange 14 lies between the two support washers 18 in the assembled state. For fixing the exhaust-gas muffler 2, a holding nut 16 is provided which can be threadably mounted on the free end of the threaded section 11.

Figure 2:
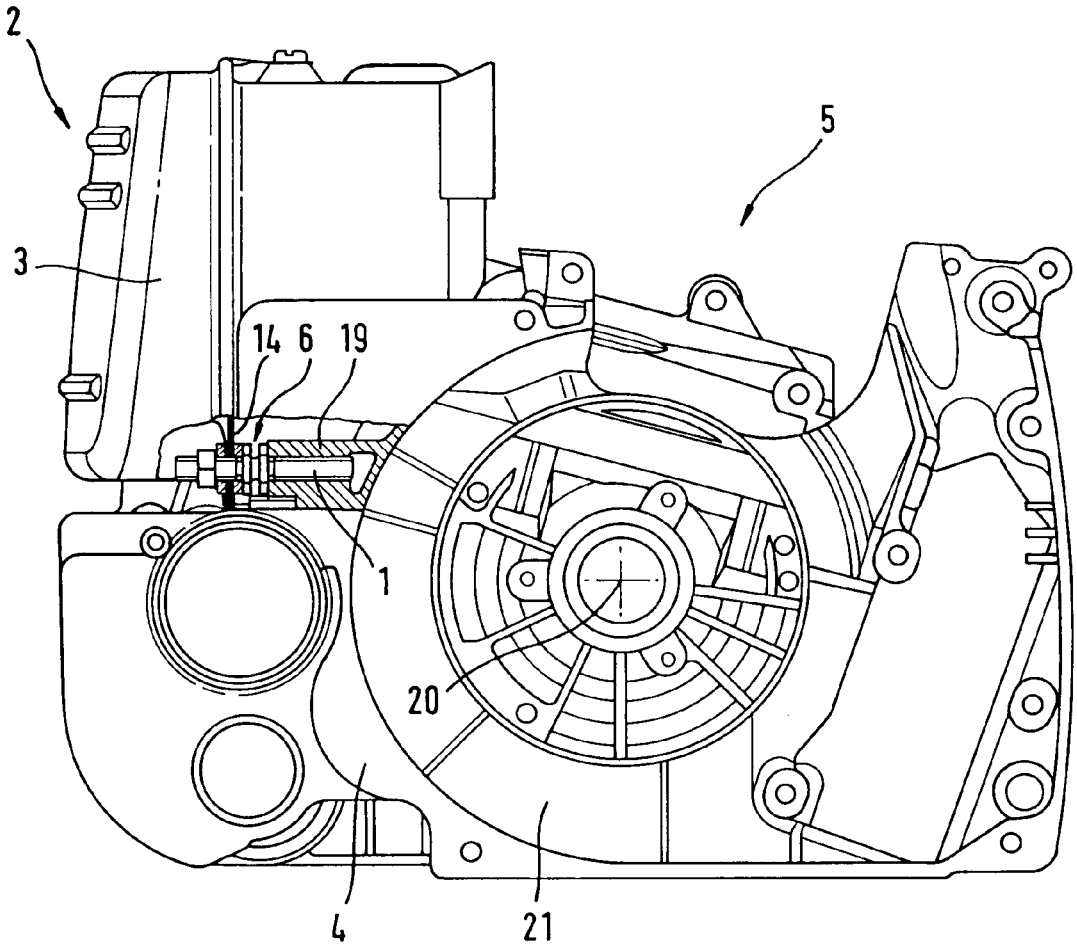
FIG. 2 is a side elevation view of the arrangement of FIG. 1 with a mounted exhaust-gas muffler.

FIG. 2 shows the arrangement of FIG. 1 in a side elevation view. The exhaust-gas muffler 2 having the exhaust-gas catalytic converter 3 is fixed on the apparatus part 4 by means of the attachment pins 1. The apparatus part 4 of the work apparatus 5 includes a cooling air spiral 21 for a fan wheel (not shown) which is rotatably journalled about a rotational axis 20. An at least partially exposed region 6 is provided on the attachment pin 1 between the holding flange 14 of the exhaust-gas muffler 2 and the threaded protuberance 19 of the apparatus part 4.

Figure 3:
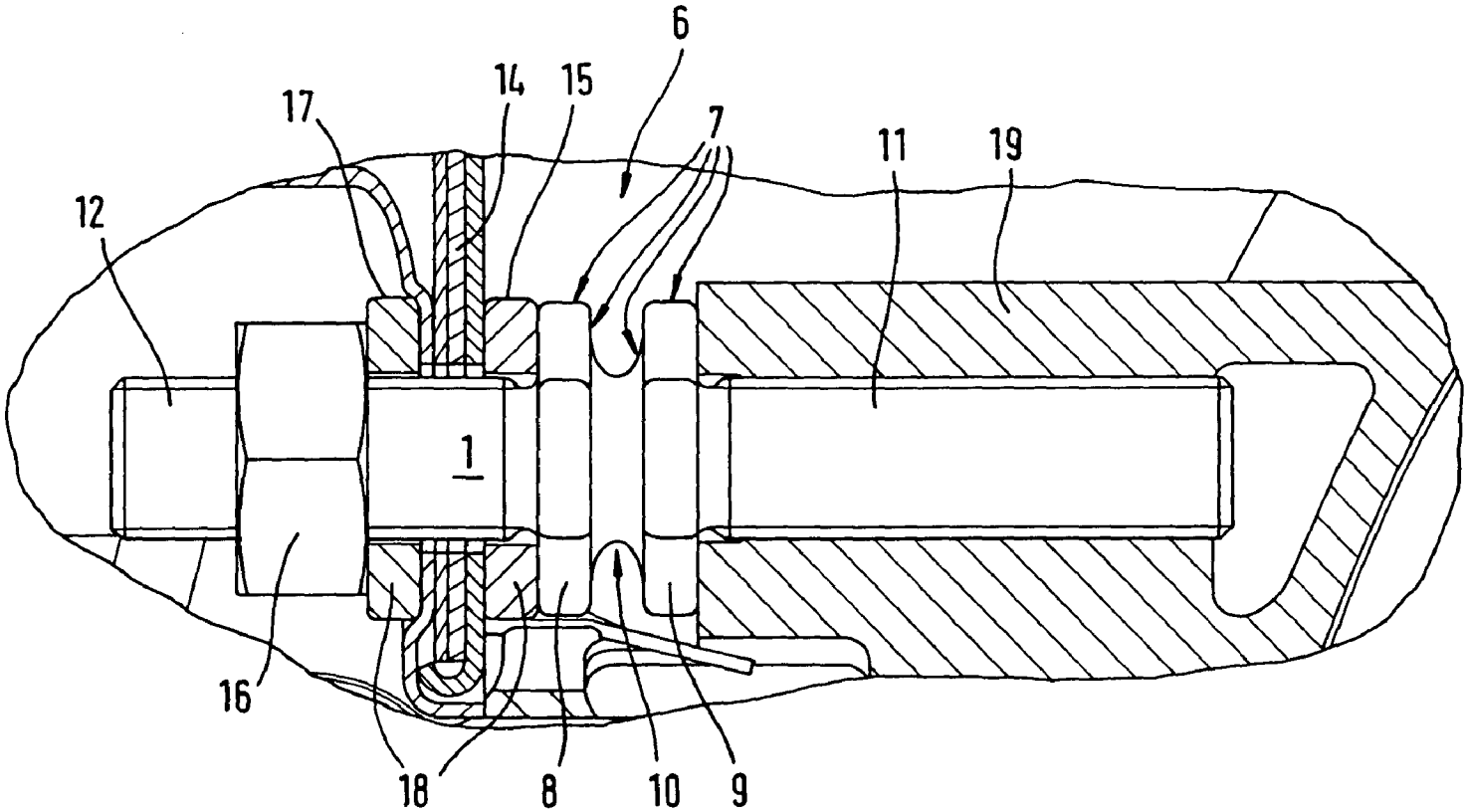
FIG. 3 is a detail enlargement of the arrangement of FIG. 2 in the region of the attachment pin; and, FIG. 4 is an enlarged detail view of a variation of the arrangement of FIG. 3 with support washers each having a centering collar.

FIG. 3 shows the arrangement of FIG. 2 in the region of the attachment pin 1. The attachment pin 1 is provided with cooling surfaces 7 in the region of the exposed region 6. The cooling surfaces 7 are formed by the apparatus-end peripherally-extending collar 9, the muffler-end peripherally-extending collar 8 as well as by the slot 10 which lies therebetween. The depth of the slot 10 is selected in such a manner that the cross section of the attachment pin 1 at the slot base corresponds approximately to its cross section in the region of the threaded sections (11, 12). Depending upon the application, a deeper or less deep slot can be practical. For configuring the cooling surfaces 7, the arrangement of a corresponding profile sleeve can be practical which can be pushed onto the attachment pin 1.

The apparatus-end threaded section 11 is threadably engaged in the threaded protuberance 19 and is optionally provided with an adhesive lock. The apparatus-end collar 9 lies in surface contact against the threaded protuberance 19.

The holding flange 14 of the exhaust-gas muffler 2 (FIGS. 1 and 2) is held between the muffler-end collar 8 and a holding nut 16 threadably engaged on the muffler-end threaded section 12. A heat-insulating spacer (15, 17) in the form of a support washer 18 is mounted between the holding flange 14 and the collar 8 as well as between the holding flange 14 and the holding nut 16. The heat-insulating spacers (15, 17) are made of titanium or a heat-resistant duroplast. The attachment pin 1 is made of steel.

In lieu of the threaded connection of the attachment pin 1 with the threaded protuberance 19 as shown, a pressed-in attachment pin as a stud bolt or other suitable configuration can be practical.

Figure 4:
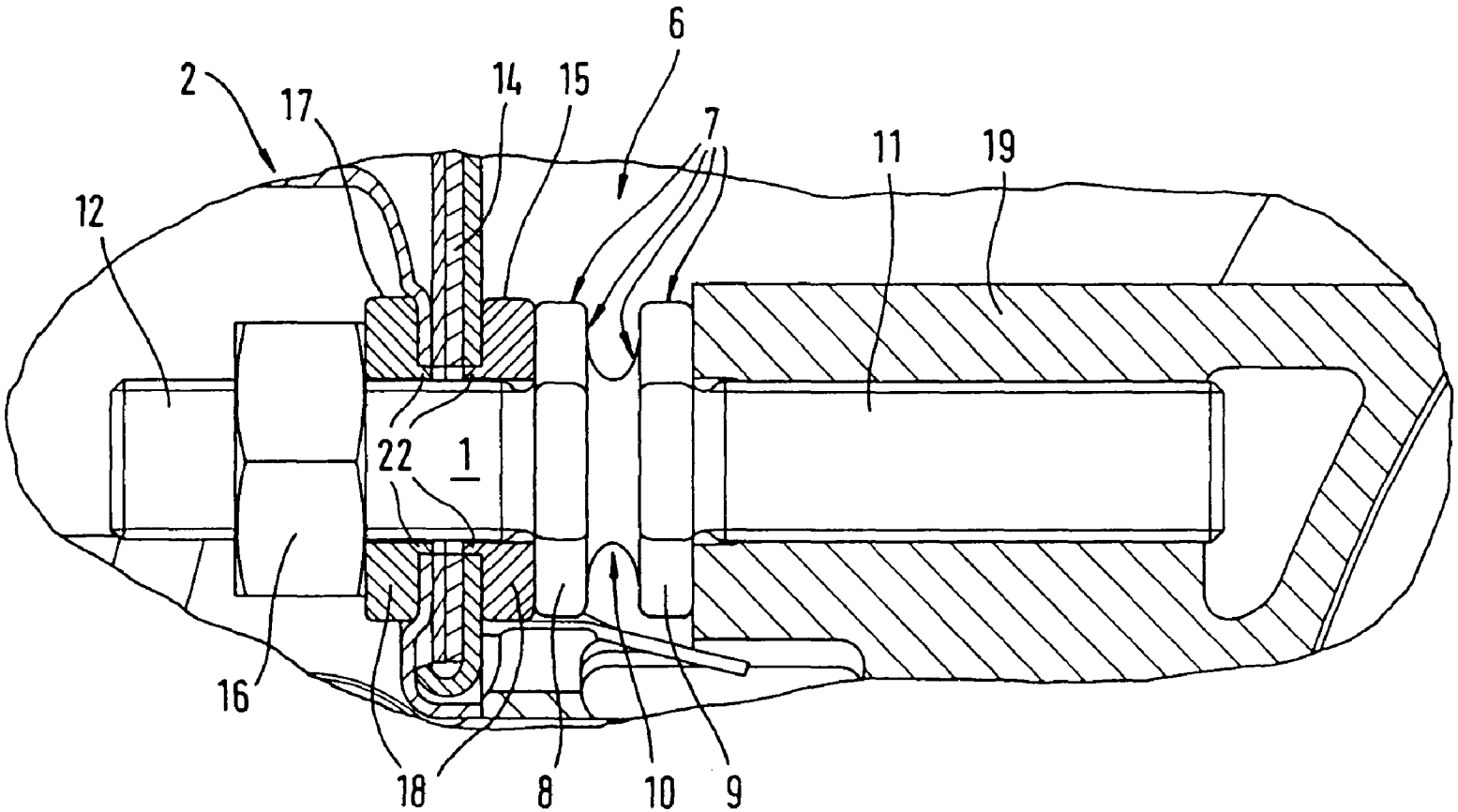

FIG. 4 shows a variation of the arrangement of FIG. 3 wherein the spacers (15, 17) in the form of support washers 18 face each other and each has a circular-round center collar 22. The center collar 22, in each case, engages without play in a bore of the holding flange 14 of the exhaust-gas muffler 2. The exhaust-gas muffler 2 is then not in direct contact with the attachment pin 1.

It is understood that the foregoing description is that of the preferred embodiments of the invention and that various changes and modifications may be made thereto without departing from the spirit and scope of the invention as defined in the appended claims.

What is claimed is:

1. An attachment pin arrangement for attaching an exhaust-gas muffler to an apparatus part of a portable handheld work apparatus driven by an internal combustion engine, the exhaust-gas muffler being provided for directing away the exhaust gases of the engine and to attenuate noise, the attachment pin arrangement comprising:

an attachment pin extending between said apparatus part and said exhaust-gas muffler;

the attachment pin having a threaded section and being threadably engaged with said apparatus part;

said attachment pin including at least a partially exposed region, said region being disposed between said apparatus part and said exhaust-gas muffler and said region defining a cooling surface for conducting away at least a part of the heat which is introduced from the exhaust-gas muffler into the attachment pin via radiation and/or convection;

said muffler having a holding flange and said attachment pin engaging said muffler at said holding flange; and, said attachment pin arrangement further including a holding nut threadably engaging said attachment pin and a heat insulating spacer mounted between said holding flange and said holding nut.

2. The attachment pin arrangement of claim 1, wherein said spacer is configured as a support washer.

3. The attachment pin arrangement of claim 2, wherein said support washer is made of titanium.

4. The attachment pin arrangement of claim 2, wherein said support washer is made of a heat resistant duroplast.

* * * * *

UNITED STATES PATENT AND TRADEMARK OFFICE

CERTIFICATE OF CORRECTION

PATENT NO. : 7,228,935 B2
APPLICATION NO. : 10/658267
DATED : June 12, 2007
INVENTOR(S) : Helmut Schlessmann It is certified that error appears in the above-identified patent and that said Letters Patent is hereby corrected as shown below:

In the Title Page:
Under (30) Foreign Application Priority Data: delete "104 41 883" and substitute -- 102 41 883 -- therefor.

Signed and Sealed this

Seventh Day of August, 2007

JON W. DUDAS
*Director of the United States Patent and Trademark Office*